US005730018A

United States Patent [19]

Kobayashi et al.

[11] Patent Number: 5,730,018

[45] Date of Patent: Mar. 24, 1998

[54] METHOD OF FORMING INTERNAL SPLINE SHAFT

[75] Inventors: Akio Kobayashi, Kuwachi-machi; Katsuyuki Morozumi, Utsunomiya, both of Japan

[73] Assignee: Mitsubishi Steel Mfg. Co., Ltd., Tokyo, Japan

[21] Appl. No.: 781,269

[22] Filed: Jan. 10, 1997

[30] Foreign Application Priority Data

Apr. 12, 1996 [JP] Japan ..... 8-091126

[51] Int. Cl.[6] ..... B21K 1/30

[52] U.S. Cl. ..... 72/264; 29/893.34

[58] Field of Search ..... 72/264, 343, 359; 29/893.34

[56] References Cited

U.S. PATENT DOCUMENTS 4,878,370 11/1989 Fuhrman et al. ..... 72/264

4,924,690 5/1990 Kanamaru et al. ..... 72/264

FOREIGN PATENT DOCUMENTS 6-126369 5/1994 Japan .

*Primary Examiner*—Lowell A. Larson

*Attorney, Agent, or Firm*—Flynn, Thiel, Boutell & Tanis, P.C.

[57] ABSTRACT

A method of forming an internal spline shaft, comprising forming splines on an inner circumferential portion of a hollow stock by cold forging in such a way that a clearance "a" between an inner diameter of the hollow stock and an outer diameter of a tool guide portion, a difference "b" between a reduced diameter of a forming land and the inner diameter of the hollow stock, and a forming-land approach angle θ satisfy respectively specific relationships. By this method, products having internal long splines can be obtained in a high yield by cold forging method.

1 Claim, 2 Drawing Sheets

METHOD OF FORMING INTERNAL SPLINE SHAFT

BACKGROUND OF THE INVENTION

1. Field of the Invention

The present invention relates to a method of manufacturing a product having long splines on its inner circumferential portion, which constitutes a propeller shaft for an automobile or the like.

2. Description of the Prior Art

In general, conventional methods of forming internal long splines make use of broaching. Although a method of internally forming splines by cold forging has been attempted, the shape and dimensions of an optimum forming land have not yet been established.

In a method of forming long splines by broaching, a broach having long and large teeth is needed, so that a large broaching machine is necessarily needed. In the case of the process of forming a large module of splines, such a tendency becomes far stronger.

In the case of forming splines by cold forging, since the shape and dimensions of an optimum forming land have not been established, dimensionally unstable manufacture has been performed.

SUMMARY OF THE INVENTION

The present invention is intended to improve the yield of products having internal long splines by using a cold forging method and to enable formation of stable internal splines by a cold forging method by determining the optimum shape and dimensions of a forming land.

The present invention provides a method of forming an internal spline shaft, the method comprising forming splines on an inner circumferential portion of a hollow stock by cold forging in such a way that a clearance"a" between an inner diameter of a the hollow stock and an outer diameter of a tool guide portion satisfies the following expression (1), a difference "b" between a reduced diameter of a forming land and the inner diameter of the hollow stock satisfies the following expression (2), and a forming-land approach angle θ satisfies the following expression (3)

$$0 \leqq 10^2 \times \log^n / \{2(D^2-d^2)-(7m)^2\} \leqq a \leqq 20^2 \times \log^n / \{2(D^2-d^2)-(7m)^2\} < 0.2 \quad (1)$$

$$0 \leqq 10^2 \times \log^n / \{(D/2)^2-(d/2)^2-(7m)^2\} \leqq b \leqq 20^2 \times \log^n / \{(D/2)^2-(d/2)^2-(7m)^2\} < 2.0 \quad (2)$$

$$\theta = \tan^{-1}(2-b) \quad (3)$$

wherein d: inner diameter of the hollow stock, D: outer diameter of the hollow stock, m: module, and n: number of teeth.

Specifically, the present invention enables optimum formation of internal splines on the basis of the specific relations found out through numerous tests, and the specific relations include, as factors, the inner and outer diameters of a stock, the outer diameter of a tool guide portion, the reduced diameter of spline forming land of tool, the module and number of teeth of splines The factors "a", "b", "c", "d", "e" and "D" are shown in FIG. 1. In FIG. 1 which is a left-half view showing the relation between a stock 1 and a tool 2, "a" indicates the clearance between the inner diameter "d" of the stock 1 and the outer diameter "c" of a tool guide portion 3 (i.e., a =d–c), "b" indicates the difference between a reduced diameter "e" of a forming land and the inner diameter "d" of the stock 1 (i.e., b=e–d), and "θ" indicates a land approach angle.

DETAILED DESCRIPTION OF THE PREFERRED EMBODIMENTS

Figure 1:
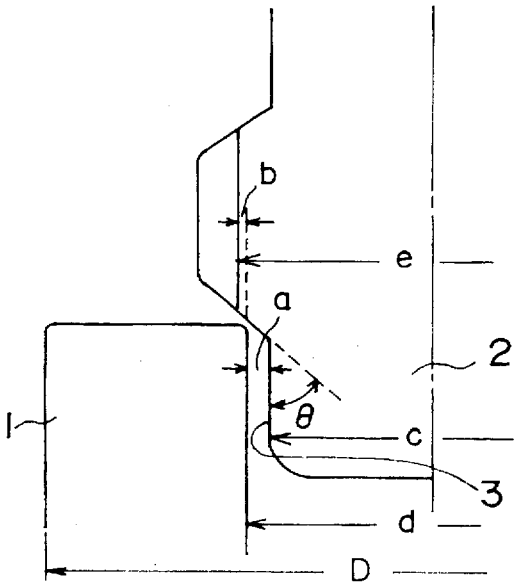
FIG. 1 is an explanatory view of the dimensional relation between a stock and a working tool.

Now, the present invention will be more specifically described hereinafter.

As can be seen from Expression (1), if 0≦a<0.2, splines can be formed, and if "a" is less than zero, the hollow stock buckles during formation. If "a" is not less than 0.2, the hollow stock inclines or falls down during formation, so that the non-uniformity of working increases to adversely affect the quality of products. The optimum range of "a" is 0.05 to 0.15 mm.

As can be seen from Expression (2), if 0≦b<2.0, the shape of long splines is optimized, and if "b" is less than zero, the splines are cracked. If "b" is not less than 2.0, the shape of the splines is impaired. The optimum range of "b" is 0.5 to 1.5 mm.

The forming-land approach angle θ needs to satisfy the condition of Expression (3). The optimum angle of "θ" is between 35 and 50°.

An example of the present invention will be described below with reference to an example and the accompanying drawings. In the drawings, the dimensions are shown in millimeter units.

EXAMPLE

Figure 2:
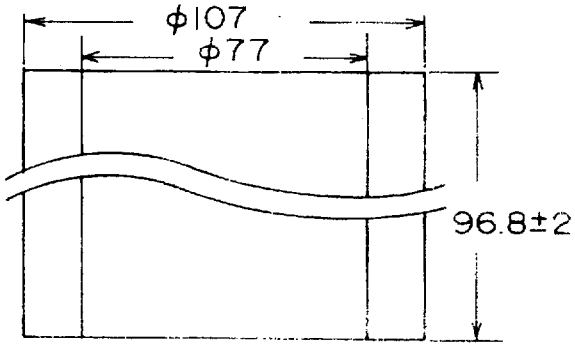
FIG. 2 is an explanatory view of the dimensions of a starting stock for formation.
Figure 3:
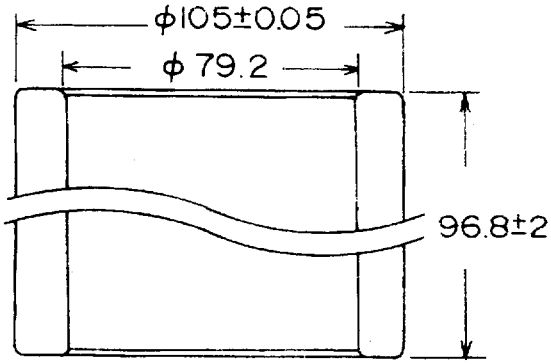
FIG. 3 s an explanatory view of the dimensions of the stock after surface working.
Figure 4:
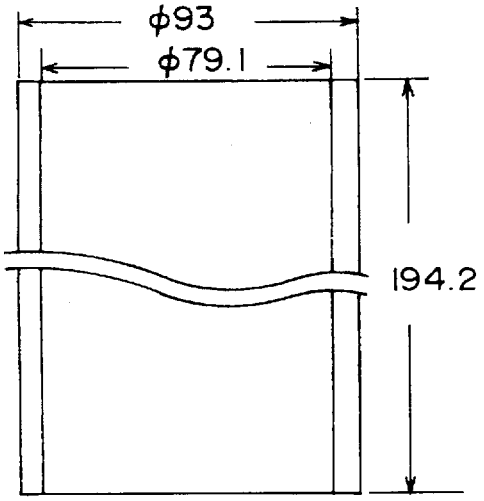
FIG. 4 is an explanatory view of the dimensions of a work stock after annealing and surface treatment.
Figure 5:
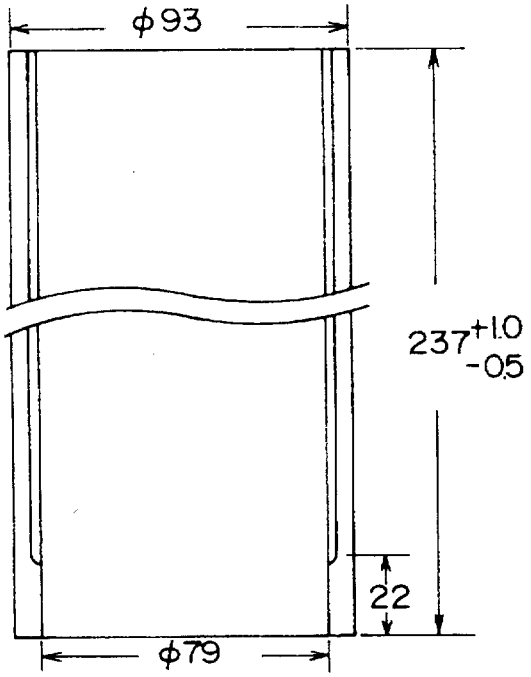
FIG. 5 is an explanatory view of the dimensions of a worked product on which splines are formed.
Figure 6:
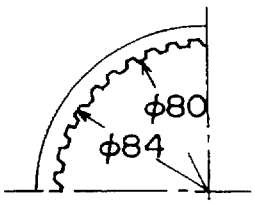
FIG. 6 is a view showing the detail of an internal spline portion.

A unit stock having the dimensions shown in FIG. 2 was formed by cutting a stock made of a material S43C specified in JIS (Japanese Industrial Standard) G4051. Such unit stock was spheroidized and was then subjected to shot blasting treatment and machining to form into the work stock shown in FIG. 3. This work stock was subjected to surface treatment followed by forward extrusion at a reduction in area of 50%, thus preparing the forming stock shown in FIG. 4. Then, the forming stock was subjected to annealing and surface treatment, and internal splines were formed by cold forging at a reduction in area of 20%, thus preparing the formed product shown in FIG. 5. FIG. 6 is a view showing the detail of an internal spline portion.

The specifications of the above-described working are summarized as follows.

inner diameter of the forming stock d: 79.1 mm outer diameter of the forming stock D: 93 mm a: d–(outer diameter "c" of tool guide portion) =0.1 mm b: (reduced diameter "e" of forming land)–d=1.0 mm approach angle θ: 45° module m: 2 number of teeth n: 40

The shape precision of a spline small-diameter portion is improved by adjusting a forming-land approach angle. It is possible to prevent a stock from inclining or falling down during formation by setting the clearance between the inner diameter of the stock and the outer diameter of a tool guide portion to not less than 0 mm and less than 0.2 mm. The difference between the inner diameter of the stock and the reduced diameter of a forming land is set to not less than 0 mm and less than 2.0 mm. This is an optimum range in that if such difference is excessively large, no splines can be projected to a sufficient extent, whereas if it is excessively small, cracks occur in the splines.

What is claimed is:

1. A method of forming an internal spline shaft, comprising forming splines on an inner circumferential portion of a hollow stock by cold forging in such a way that a clearance "a" between an inner diameter of said hollow stock and an outer diameter of a tool guide portion satisfies the following expression (1), a difference "b" between a reduced diameter of a forming land and the inner diameter of said hollow stock satisfies the following expression (2), and a forming-land approach angle θ satisfies the following expression (3).

$$0 \leqq 10^2 \times \log^n / \{2(D^2-d^2)-(7m)^2\} \leqq a \leqq 20^2 \times \log^n / \{2(D^2-d^2)-(7m)^2\} < 0.2 \quad (1)$$

$$0 \leqq 10^2 \times \log^n / \{(D/2)^2-(d/2)^2-(7m)^2\} \leqq b \leqq 20^2 \times \log^n / \{(D/2)^2-(d/2)^2-(7m)^2\} < 2.0 \quad (2)$$

$$\theta = \tan^{-1}(2-b) \quad (3)$$

wherein d: inner diameter of said hollow stock, D: outer diameter of said hollow stock, m: module, and n: number of teeth.

* * * * *